US011549754B2

(12) United States Patent
Schmidt et al.

(10) Patent No.: US 11,549,754 B2
(45) Date of Patent: Jan. 10, 2023

(54) METHOD FOR FITTING OR RETROFITTING A SINTER COOLER

(71) Applicants: PAUL WURTH S.A., Luxembourg (LU); PAUL WURTH DEUTSCHLAND GMBH, Wiesbaden (LU)

(72) Inventors: Eugen Schmidt, Weiterstadt (DE); Andrej Schulakow-Klass, Wiesbaden (DE)

(73) Assignees: PAUL WURTH S.A., Luxembourg (LU); PAUL WURTH DEUTSCHLAND GMBH, Wiesbaden (DE)

( * ) Notice: Subject to any disclaimer, the term of this patent is extended or adjusted under 35 U.S.C. 154(b) by 0 days.

(21) Appl. No.: 17/299,170

(22) PCT Filed: Dec. 6, 2019

(86) PCT No.: PCT/EP2019/083996

§ 371 (c)(1),
(2) Date: Jun. 2, 2021

(87) PCT Pub. No.: WO2020/120319

PCT Pub. Date: Jun. 18, 2020

(65) Prior Publication Data

US 2022/0049899 A1 Feb. 17, 2022

(30) Foreign Application Priority Data

Dec. 11, 2018 (EP) ..... 18211742

(51) Int. Cl.
*F27D 15/02* (2006.01)
*C22B 1/26* (2006.01)

(52) U.S. Cl.
CPC ..... *F27D 15/022* (2013.01); *C22B 1/26* (2013.01); *F27D 15/0266* (2013.01); *F27D 2015/024* (2013.01); *F27D 2015/0226* (2013.01)

(58) Field of Classification Search
CPC ..... F27D 15/0213; F27D 15/022; F27D 2015/0226; F27B 21/02; F27B 21/06; C22B 1/26
See application file for complete search history.

(56) References Cited

U.S. PATENT DOCUMENTS 5,299,555 A * 4/1994 Claes ..... F27D 15/022 110/291
5,947,719 A * 9/1999 Heinemann ..... F27D 15/022 432/78

(Continued)

FOREIGN PATENT DOCUMENTS

CN 101482370 A 7/2009
CN 108168321 A 6/2018

(Continued)

OTHER PUBLICATIONS

International Preliminary Report of Patentability for corresponding application PCT/EP2019/083996 filed Dec. 6, 2019; dated Feb. 25, 2021.

(Continued)

*Primary Examiner* — Gregory A Wilson
(74) *Attorney, Agent, or Firm* — Cantor Colburn LLP

(57) ABSTRACT

A method for fitting or retrofitting a sinter cooler, which sinter cooler has a cooler grate chain with an endless chain of cooler cars, the method including, installing a lamella grate for holding sinter material and allowing air flow through the grate so that a support structure is connected to the cooler car and a plurality of lamellae are supported by and individually movable with respect to the support struc- (Continued)

ture, and are disposed to allow air flow between neighbouring lamellae, where the support structure has at least one support element disposed underneath the plurality of lamellae to support the plurality of lamellae, and at least one downholder that is adapted to limit an upward motion of at least one lamella installed such that at least a portion of the downholder is disposed above the at least one lamella.

23 Claims, 6 Drawing Sheets

(56) References Cited

U.S. PATENT DOCUMENTS

| | | | | |
|---|---|---|---|---|
| 5,992,334 | A * | 11/1999 | von Wedel | F27D 15/0213 126/153 |
| 7,093,457 | B2 * | 8/2006 | Foresman | C22B 1/26 62/381 |
| 7,862,333 | B2 * | 1/2011 | Schinke | F16K 7/07 432/78 |
| 8,132,520 | B2 * | 3/2012 | von Wedel | B65G 25/065 110/328 |
| 10,816,268 | B2 * | 10/2020 | Wedel | F27D 15/022 |
| 2005/0160758 | A1 | 7/2005 | Foresman | |

FOREIGN PATENT DOCUMENTS

| | | | | |
|---|---|---|---|---|
| DE | 10133973 | A1 * | 2/2003 | F23H 17/08 |
| EP | 3382311 | A1 | 10/2018 | |
| JP | 0247224 | A | 2/1990 | |
| JP | 11159968 | A | 6/1999 | |
| KR | 20180086703 | A | 8/2018 | |
| WO | 2018134194 | A1 | 7/2018 | |

OTHER PUBLICATIONS

International Search Report for corresponding application PCT/EP2019/083996 filed Dec. 6, 2019; dated Jan. 22, 2020.

Written Opinion for corresponding application PCT/EP2019/083996 filed Dec. 6, 2019; dated Jan. 22, 2020.

* cited by examiner

PRIOR ART

PRIOR ART

METHOD FOR FITTING OR RETROFITTING A SINTER COOLER

TECHNICAL FIELD

The disclosure relates to a method for fitting or retrofitting a sinter cooler.

BACKGROUND

In iron metallurgy, travelling grate machines are used for several purposes, e.g. for performing a sintering process or for cooling sinter material. In each case, material is loaded onto a travelling grate and is thermally treated as it is conveyed on the travelling grate. The travelling grate, which may be used in sintering machines as well as in sinter coolers, is realised by an endless chain of grate cars which move along rails. In the context of sinter coolers, the travelling grate is also referred to as cooler grate chain and grate cars can be referred to as cooler cars.

In this context, the annular dip-rail cooler, e.g. of the Lurgi type, has found extensive use during the last decades. It comprises an annular cooler that is divided into several cooler cars with grates. Hot sinter material is loaded onto the cooler and cooled with ambient air that is blown through the sinter layer. After the sinter has been cooled sufficiently, the cooler car is tilted and the sinter falls into a bunker or bin below. Effectiveness of such coolers mainly depends on the amount of cooling air available. To this respect, the grates through which cooling air passes are a decisive component of the process. The design of the grates and their condition during operation has a decisive impact on cooling effectiveness.

A problem related to e.g. annular sinter coolers of the Lurgi type, which is the basis for many other technology providers, is that fine sinter material can fall through the rigid grate and thus contaminate or clog other components that are relevant for the process. The current solution for this problem is to install collecting pans below the grate, which are supposed to collect any spilled material and which are afterwards emptied in the discharge area. The intention is to protect the inner components of the plant, like air channels or wind boxes or sealing elements, from increasing contamination. Such contamination can block process air flow such that the general amount of air flow available for cooling will be reduced. The collecting pans, however, seriously impair the airflow through the sinter material. Another drawback of the current grate design or annular dip rail cooler design is that it comprises rigid gratings that are susceptible to blockage by fine sinter material (near-mesh particles). The effective gap for cooling air is often blocked, since these grates have no self-cleaning functionality. This has a serious negative impact on the cooling efficiency of the sinter cooler.

BRIEF SUMMARY

The disclosure provides for increasing the effectiveness of existing sinter coolers.

The disclosure provides a method for fitting or retrofitting a sinter cooler. In the latter case, one might also say that this is a method for converting or upgrading a sinter cooler. The sinter cooler comprises a cooler grate chain with an endless chain of cooler cars, each cooler car having a front edge and a rear edge, and in the case of retrofitting, a rigid grate for holding sinter material and allowing air flow through the rigid grate. Normally, the cooler cars move on a pair of endless or circular rails and form an endless chain. In a loading area, hot sinter is dropped onto the cooler grate chain and is then conveyed by the moving cooler cars to a discharge area, where it is unloaded or dropped from the cooler cars. Between the loading area and the discharge area, the grate normally moves more or less horizontally. During transport, the hot sinter is cooled by an air stream that flows in a more or less vertical direction, usually from underneath the cooler cars through the grate and then through the sinter material, which is thereby cooled. Each cooler car, at the beginning of the method, has a rigid grate, i.e. the grate that is designed to hold or support the sinter material normally has no movable parts. For example, such a grate may comprise metal sheets or plates with a plurality of slots that are designed to provide the necessary space for the cooling air stream. It may also comprise a plurality of vanes that are rigidly connected to a frame, wherein air gaps are provided between neighbouring vanes.

The inventive method comprises, for at least one cooler car, removing the rigid grate. This may e.g. include removing plates as mentioned above and optionally other components. Furthermore, the method comprises installing a lamella grate so that a support structure is connected to the cooler car and a plurality of lamellae are supported by and individually movable with respect to the support structure and are disposed to allow air flow between neighbouring lamellae. One could also say that the rigid grate is replaced by the lamella grate. It should be noted that while the inventive method is carried out for at least one cooler car, normally a plurality of cooler cars or all cooler cars of the sinter cooler are retrofitted as described in here.

The support structure comprises at least one support element disposed to support a plurality of lamellae. In other words, the respective support element is installed so that it supports a plurality of lamellae. In the fully assembled state, the respective support element is normally disposed underneath the lamellae. An upper contour of the support element can at least partially correspond to a profile of the lamellae. For example, the upper contour may comprise a curved portion that is adapted to receive the concave portion of the lamella.

Furthermore, at least one downholder is installed that is adapted to limit an upward motion of at least one lamella. Preferably, the downholder is adapted to limit the upward motion of a plurality of lamellae. Normally, at least a portion of the downholder is disposed above the lamellae so that an upward motion of the respective lamella is at least limited to a certain degree, which includes the possibility that an upward motion is completely prevented. For example, the downholder may comprise a vertically extending main portion that is disposed laterally with respect to the lamellae and a flange portion that extends from an upper part of the main portion above the lamellae. The flange portion would then block an upward motion of the lamellae. One function of the downholder may be to prevent one lamella from moving too far away from a neighbouring lamella, thereby limiting the size of a gap between two neighbouring lamellae.

Installing the lamella grate may include connecting the support structure permanently or non-permanently to the cooler car, e.g. by screwing, welding or riveting. The car normally comprises a frame or chassis, which is in general a reasonably solid structure to which other components of the car can be mounted. Also, track rollers of the car are normally rotatably coupled to the chassis and disposed on opposite sides of the chassis. This support structure of the lamella grate can be connected to the chassis. It should be noted though, that at least parts of the support structure may belong to the original configuration with the rigid grate and thus can be "reused" for the lamella grate. While the frame or chassis is normally left unchanged by the inventive method, it is also conceivable parts of the chassis are removed and optionally replaced. When installing the lamella grate has been finished, the support structure is connected to the cooler car and a plurality of lamellae are supported by the support structure.

At the same time, the lamellae are individually movable with respect to the support structure. Normally, the support structure itself is not movable with respect to e.g. the chassis of the cooler car, but each lamella is individually movable. Within the scope of the disclosure, such mobility may include any kind of rotation or linear movement. The range of motion allowed for each lamella can be rather small in comparison to the dimensions of the lamella and the cooler car.

Since the lamellae are individually movable, the distance between two neighbouring lamellae is not constant but changes, at least from time to time. Therefore, sinter material normally cannot be permanently stuck between two lamellae but can be e.g. removed by gravity when the cooler car reaches the discharge area. In this discharge area, the individual cooler car is normally tilted to allow the sinter material to fall off. At the same time, the lamellae are likely to move with respect to each other and sinter material stuck between neighbouring lamellae can be removed by gravity. Therefore, the retrofitted sinter cooler has a self-cleaning ability, i.e. a self-cleaning effect of the grate can be achieved. Thus, an effective airflow can be maintained over a long time without the necessity for cleaning.

It should also be noted that the inventive method involves a relatively small change of the sinter cooler as a whole, thereby making it cost and time effective. Replacing the rigid grate with the lamella grate can be carried out during a normal maintenance operation of the respective cooler car. It is possible to replace the rigid grates of all cooler cars during one maintenance shutdown or to perform replacement on only some of the cooler cars and then operating the sinter cooler for some time with a mixed configuration (i.e. some cooler cars having rigid grates and some having lamella grates) and then performing replacement on the remaining cooler cars later. As will be further explained below, the inventive method can be performed on various types of sinter coolers.

According to one embodiment, installing the lamella grate comprises at least partially connecting the support structure to the cooler car and afterwards installing at least some lamellae on the support structure. In other words, the support structure and the lamellae are not installed as a pre-assembled assembly, but the support structure is first mounted to the cooler car (e.g. the chassis) and once the support structure is in place, the lamellae can be installed. Alternatively, it is possible that the lamella grate is pre-assembled with the lamellae already in place with respect to the support structure and the whole lamella grate is connected to the cooler car by connecting the support structure.

It is highly preferred that at least one lamella having a profile with a concave portion and an overlap portion is installed so that the concave portion that is upward concave and the overlap portion overlaps the concave portion of a neighbouring lamella from above. Normally, at least a majority of the lamellae or even all lamellae have a profile with such a concave portion and an overlap portion. The respective concave portion is installed so that it is upward concave, i.e. it is concave as viewed from above the cooler car when the lamella grate is in position. During operation of the sinter cooler, dust, sinter or other material can be collected and held in the concave portion, which forms a kind of receptacle or trough for the material. When installed, the overlap portion overlaps the concave portion of a neighbouring lamella from above. Since the overlap portion overlaps the concave portion, at least some sinter material is prevented from falling or sliding into the concave portion, which prevents the concave portion from becoming filled with material too quickly. Normally, the overlap portion is vertically spaced from the concave portion of the neighbouring lamella so that a gap is formed in between to enable airflow. It is preferred that at least a majority or even all lamellae comprise a concave portion and an overlap portion. Along the profile of the lamella, the overlap portion is preferably disposed opposite the concave portion. Thus, each concave portion can be overlapped and thereby covered or shielded by the overlap portion of another lamella. During operation, a major part of the sinter or other material can be supported by the overlap portions without falling into the concave portions. The overall profile of the respective lamella may be roughly S-shaped, with the concave portion connected to an upwards slanted rising portion, which in turn is connected to the overlap portion, which may at least partially be horizontal.

It is preferred that the overlap portion is disposed to overlap a concave portion of a lamella that is disposed behind with respect the travelling direction of the cooler car. In other words, the overlap portion of a first lamella overlaps the concave portion of a second lamella, wherein the first lamella is disposed in front of the second lamella. This configuration helps to prevent excessive amounts of material from falling into the gap between the two lamellae, which would result in an early filling of the concave portion. Rather, the overlap portion shields the concave portion from most of the material and only smaller amounts of material need to be received within the concave portion. Here and in the following, the travelling direction of the cooler cars is the direction in which the cooler cars move and of course corresponds to the direction of the rails on which they run. This travelling direction may also be regarded as the longitudinal direction, whereas a horizontal direction perpendicular to the longitudinal direction may be regarded as the lateral direction.

According to designs known in the art, the cooler car comprises at least one collecting pan disposed beneath the rigid grate to collect material falling through the rigid grate. Such material may be sinter or other particles or dust that is placed on the rigid grate but falls through the openings in the grate. In particular, but not exclusively, if the lamellae comprise a concave portion and an overlap portion as described above, material can largely be prevented from falling from the lamella grate, thus making the collecting pans unnecessary. Therefore, the method preferably comprises removing the at least one collecting pan. Since the collecting pans normally severely obstruct the airflow underneath the grate, removing the pans decisively enhances the airflow and therefore the effectiveness of the cooling process.

There are different arrangements of lamellae possible within the scope of the disclosure. According to a preferred configuration, a plurality of lamellae are installed as a lamella group so that the lamellae are disposed successively along a travelling direction of the cooler car. In other words, these lamellae are staggered along the travelling direction of the car. Some of the lamellae may extend perpendicular to the travelling direction. It is conceivable that the lamella grate comprises only one lamella group, which could extend over most of the width of the cooler car. However, there is preferably a plurality of lamella groups. This can be advantageous for different reasons. For example, in case a lamella has to be replaced due to wear or damage, the respective lamella is smaller, which normally facilitates replacement. Also, the mobility of a smaller lamella may be easier maintained for a longer time than the mobility of a larger lamella.

All lamellae of at least one lamella group can be installed to be parallel to each other and to one edge of the cooler car. This may be either the front edge or the rear edge. If the front edge and the rear edge are slanted with respect to each other, the lamellae can only be parallel to one edge, while they are disposed at an angle with respect to the other edge. In this embodiment, the lamellae adjacent the other edge normally need to have different lengths.

Preferably, at least two lamella groups are installed to be offset to each other perpendicular to the travelling direction, wherein a downholder is installed between two neighbouring lamella groups. In this embodiment, the downholder is configured to act on both lamella groups, i.e. to limit the upward motion of the lamellae in both lamella groups. At the same time, a main portion of the downholder as described above can be disposed between the two lamella groups, thereby limiting a lateral motion of the lamellae in both lamella groups. In other words, the downholder can serve as a separation element between the two lamella groups.

According to another embodiment, at least one lamella group is installed so that the lamellae at the front edge of the cooler car and the rear edge of the cooler car are parallel to the respective edge. In this embodiment, the lamellae at the front edge and at the rear edge can have at least approximately or even exactly the same length. Also, the connection between the lamellae and the stationary part of the cooler car, e.g. the support structure, is less complicated. Normally, the alignment of the lamellae in the respective lamella group changes gradually along the travelling direction from the parallel alignment with the front edge to the parallel alignment with the rear edge. Preferably, the lamellae are radially aligned with respect to the centre of the sinter cooler.

According to one embodiment, at least one straight downholder is installed. This refers to the shape of the downholder is viewed from above. In particular, all downholders can be straight. The alignment of the respective downholder normally corresponds to a tangential direction with respect to the centre of the sinter cooler. Also, if there are several downholders within a single lamella grate, these downholders are normally stalled to be parallel.

Additionally or normally alternatively, at least one arcuate downholder can be installed. The downholder is arcuate or bent along an arc that normally is normally aligned to the centre of the sinter cooler. This design can be advantageous in that the lamellae disposed between two such arcuate downholders can have exactly the same length, which facilitates the production and maintenance.

The inventive method can be used for different types of sinter coolers. For example, the sinter cooler can be a circular cooler, wherein each cooler car has a front edge slanted with respect to a rear edge. A circular cooler can be characterised by a centre, wherein the cooler cars and their tracks are concentrically disposed around the centre. Normally, the front edge and the rear edge of the cooler car are aligned towards the centre, i.e. along a radial direction with respect to the centre. In this context, the front edge is the edge that faces in the travelling direction of the car. The overall shape of the cooler car as viewed from above is roughly trapezoidal.

The inventive method can also be applied if the sinter cooler is a linear cooler. As known in the art, such a linear sinter cooler comprises an upper run and a lower run, wherein the cooler cars are turned upside down when passing through the lower run. For such a linear cooler, the front edge of each cooler car is normally parallel to the rear edge and the overall shape of the cooler car as viewed from above is roughly rectangular. It is understood that some design aspects are less complicated than for a circular cooler. For example, all lamellae in a lamella group can be arranged parallel to each other and parallel to the front edge and to the rear edge at the same time.

BRIEF DESCRIPTION OF THE DRAWINGS

Preferred embodiments of the disclosure will now be described, by way of example, with reference to the accompanying drawings, in which.

DETAILED DESCRIPTION

Figure 1:
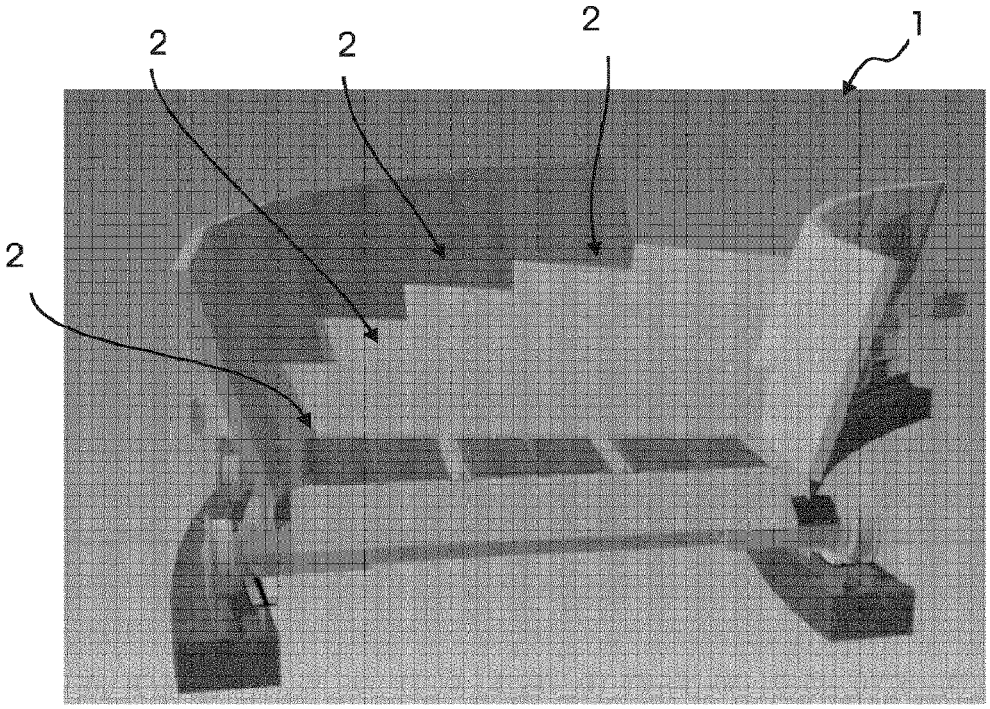
FIG. 1 is a perspective view of a part of an annular sinter cooler.
Figure 2:
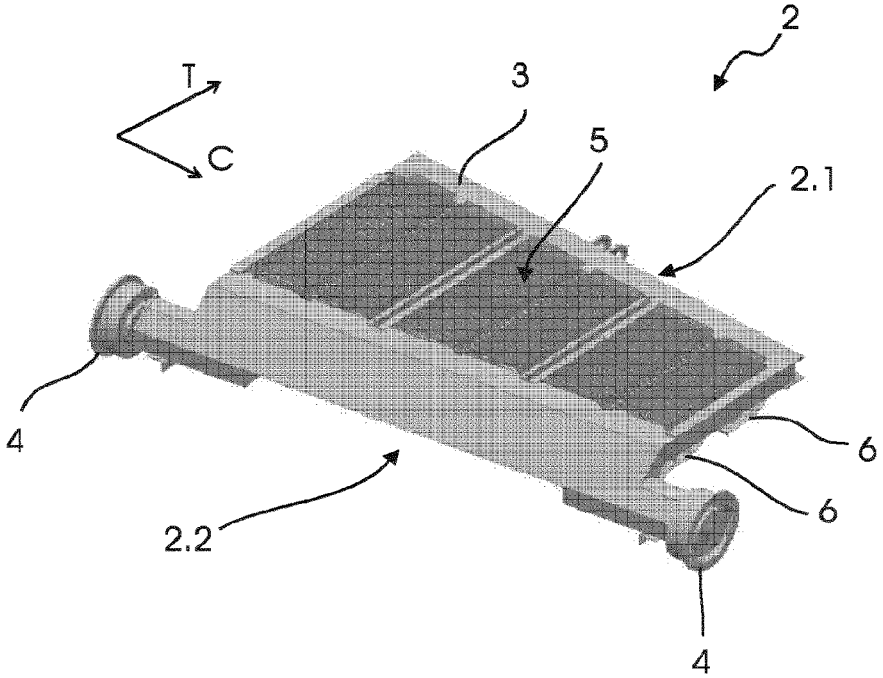
PRIOR ART Fig.2
FIG. 2 is a perspective view of a cooler car for the annular sinter cooler of FIG. 1.
Figure 3:
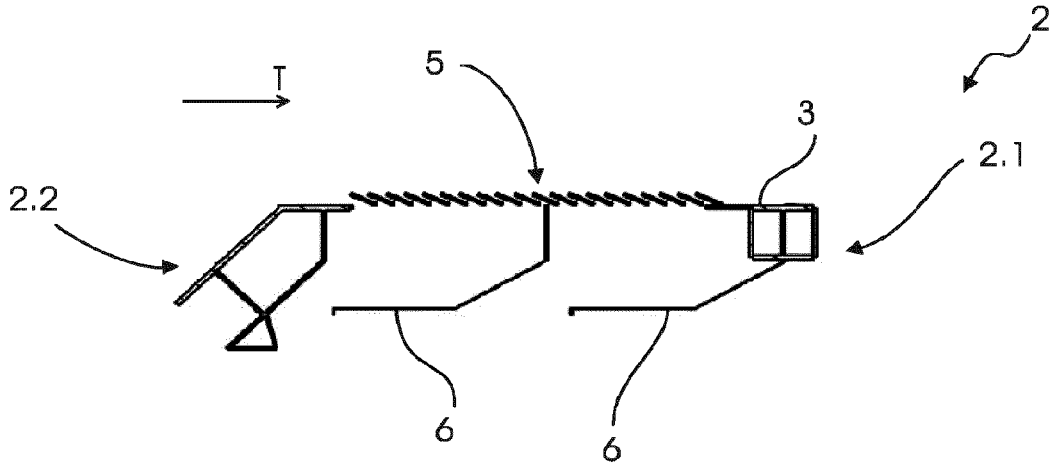
FIG. 3 is a sectional side view of a cooler car with rigid grate according to the state of the art.

FIG. 1 shows a perspective view of a part of an annular sinter cooler 1 that can be retrofitted by the inventive method. The sinter cooler 1 comprises a cooler grate chain for by an endless chain of cooler cars 2 that run on circular rails. FIGS. 2 and 3 show a cooler car 2 of the sinter cooler 1. The cooler car 2 comprises a chassis (or frame) 3 to which two track rollers 4 are rotatably mounted. Furthermore, a rigid grate 5 is connected to the chassis 3, e.g. by welding. The rigid grate 5 is designed to carry sinter material while at the same time allowing air flow through a plurality of slots. In the embodiment shown, the track rollers 4 are disposed—with respect to a travelling direction T of the cooler car 2—at a rear edge 2.2 of the cooler car 2, which is slanted with respect to a front edge 2.1. In other words, the cooler car 2 has a roughly trapezoidal shape, so that all cooler cars 2 of the endless chain form an annular cooler grate chain. As can be seen in particular in the sectional view of FIG. 3, two collecting pans 6 are mounted underneath the chassis, which are designed to collect any material falling through the rigid grate 5.

According to a first embodiment of the inventive method, which will now be described with reference to FIGS. 4 and 5, the sinter cooler 1 is to be retrofitted a refit of each cooler car 2. It should be noted that the inventive method can be carried out basically the same way for a cooler car 2 of a linear sinter cooler (not shown). It is understood that for a linear sinter cooler, the front edge 2.1 and the rear edge 2.2 need to be parallel.

Figure 4:
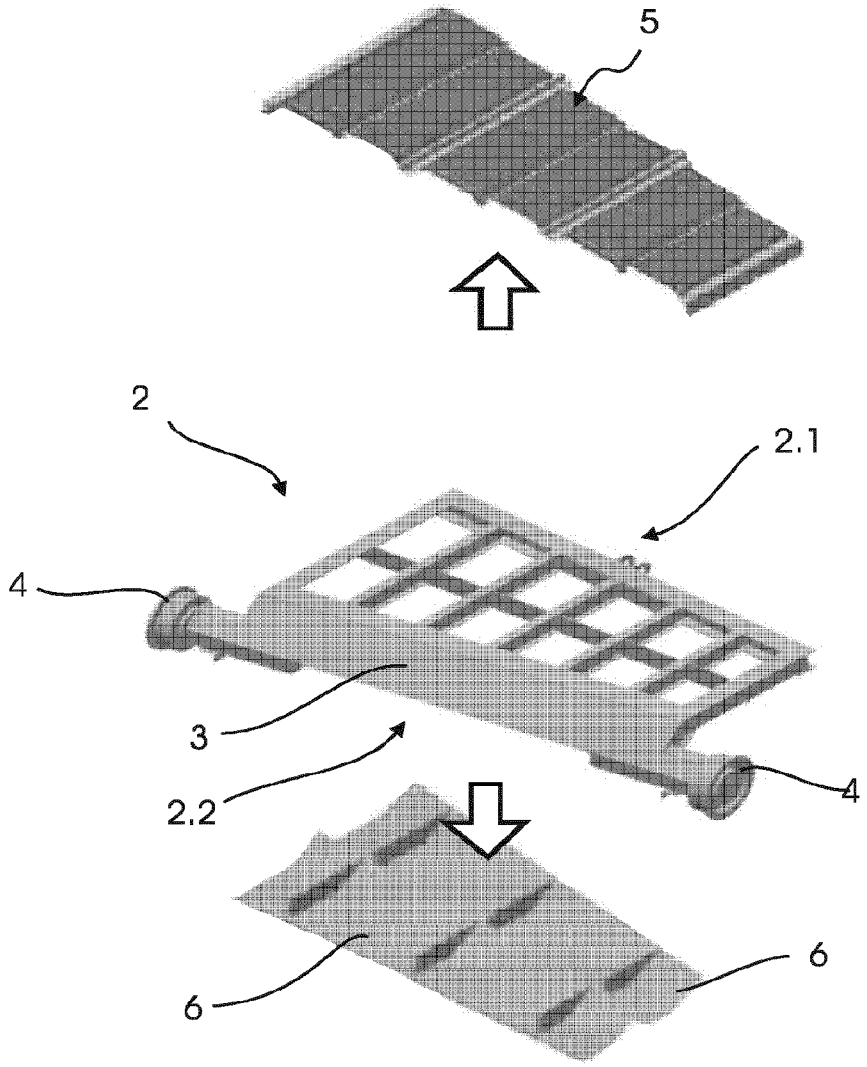
FIG. 4 is perspective view illustrating a first part of a first embodiment of the inventive method.
Figure 5:
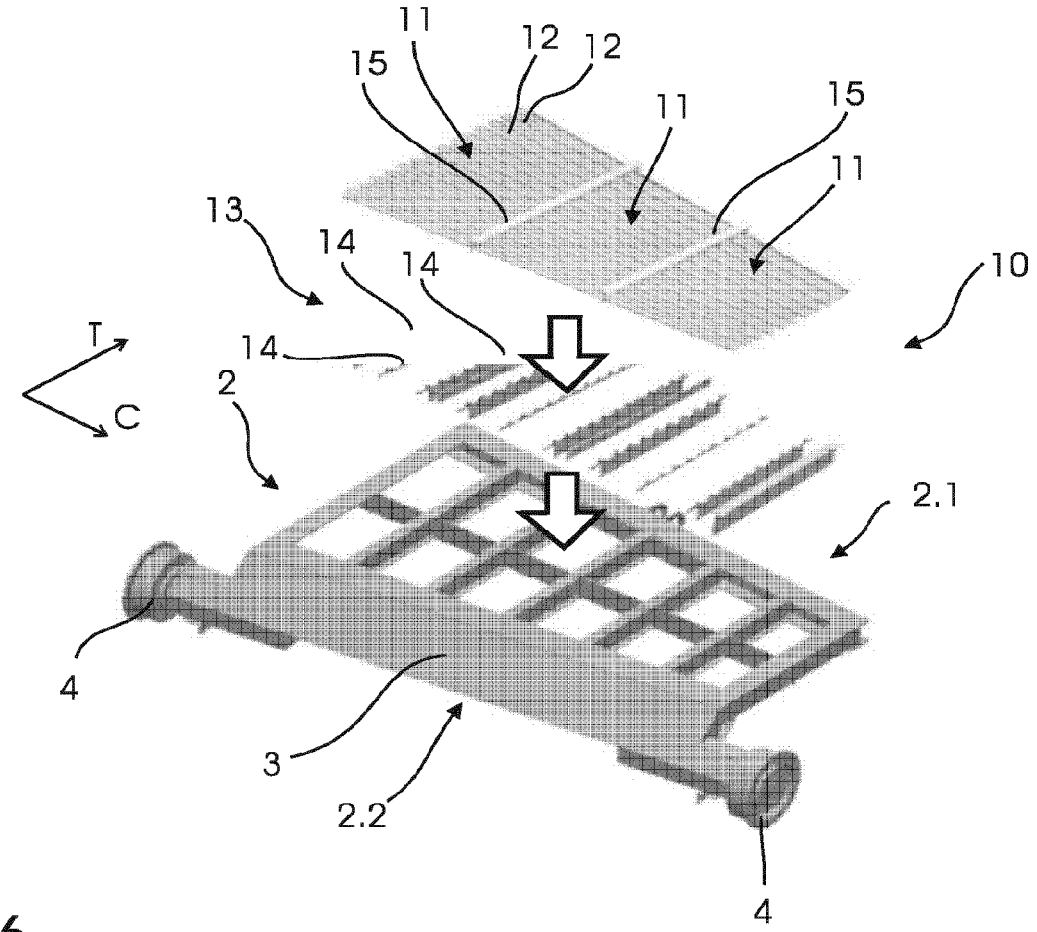
FIG. 5 is perspective view illustrating a second part of the first embodiment of the inventive method.

As shown in FIG. 4, the retrofitting process includes that the rigid grate 5 as well as the collecting pans 6 are removed from the chassis 3. This may be performed when the cooler car 2 is removed from the sinter cooler 1 for routine maintenance. The major part of the cooler car 2, including the chassis 3 and the track rollers 4, remains unchanged by the retrofitting process. Afterwards, a lamella grate 10 is installed on the chassis 3. This includes connecting a plurality of support elements 14 which form a support structure 13 of the lamella grate 10. The connections can be established e.g. by welding. Once the support elements 14 are in position, a plurality of lamellae 12 are placed thereon. The lamellae 12 can be divided in three lamella groups 11, which are offset to each other along a centre direction C that is perpendicular to the travelling direction T and points towards the centre (not shown) of the sinter cooler 1 Within each lamella group 11, the lamellae 12 are disposed successively along the travelling direction T of the cooler car 2. A plurality of downholders 15 are placed on top of the lamellae 12, with one downholder 15 disposed between each two lamellae groups 11. The lamellae 12 are loosely placed on the support elements 14, while the downholder 15 has a flange portion 15.1 (see FIG. 8) that limits an upward movement of the lamellae 12. Still, the lamellae 12 are individually movable with respect to the support structure 13.

Figure 6:
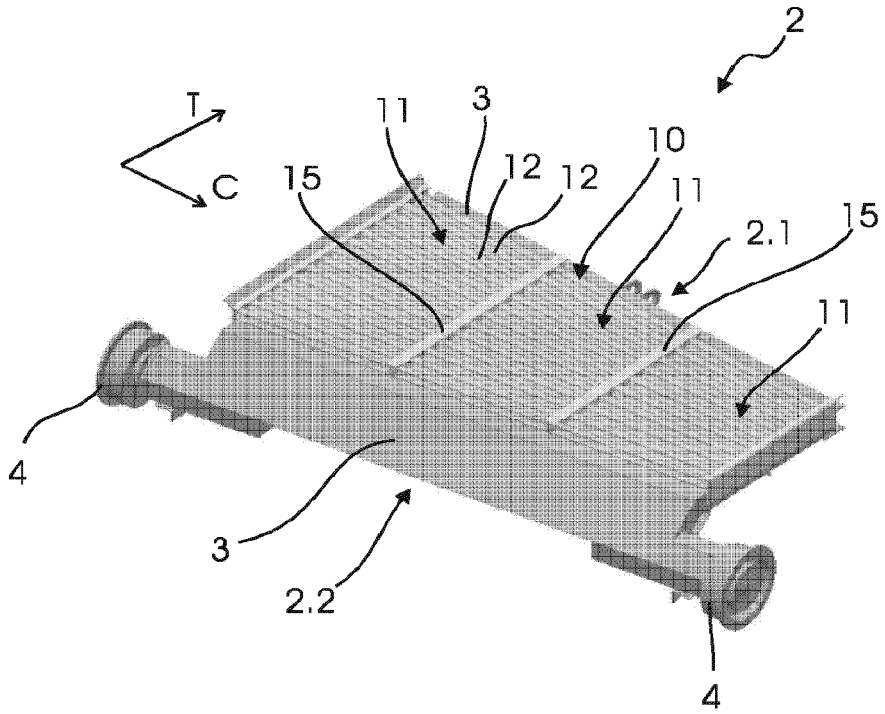
FIG. 6 is a perspective view of the cooler car from FIG. 2 after being retrofitted by the inventive method.
Figure 7:
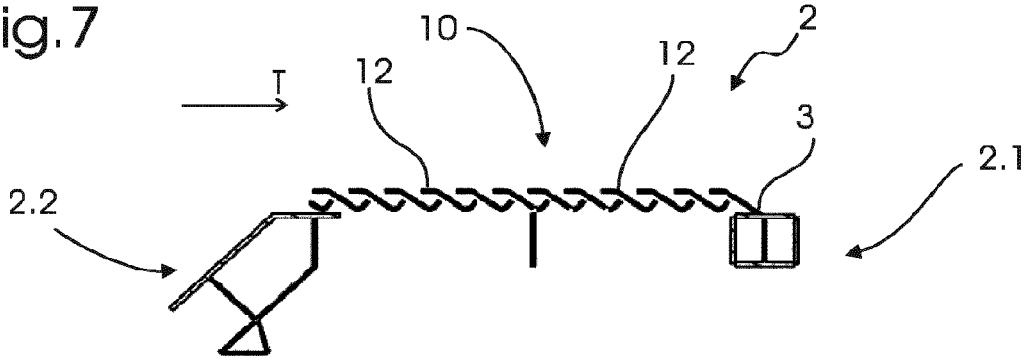
FIG. 7 is a sectional side view of the cooler car from FIG. 6.
Figure 8:
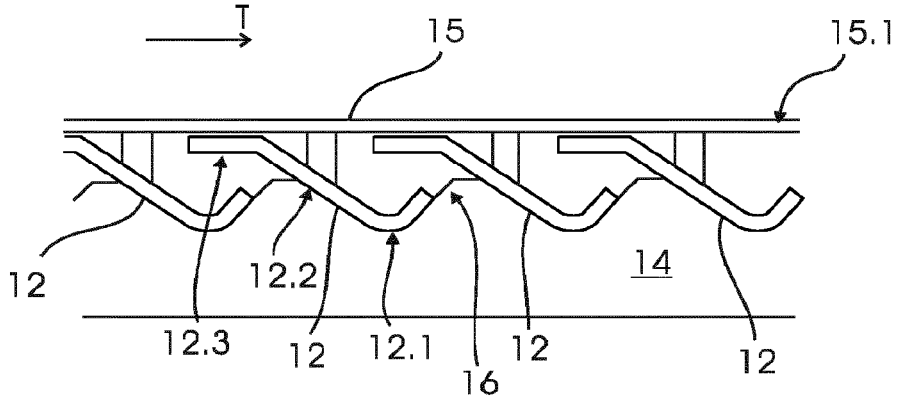
FIG. 8 is a sectional side view of a detail of the cooler car from FIG. 6.
Figure 9:
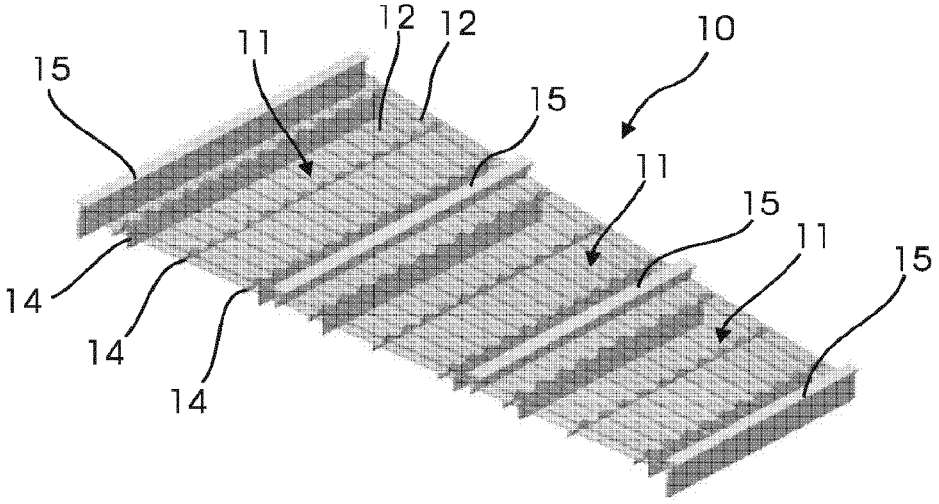
FIG. 9 is a perspective view of a lamella grate of the cooler car from FIG. 6.

FIGS. 6 to 8 illustrate the cooler car 2 after the lamella grate 10 has been installed, while FIG. 9 shows the lamella grate 10 without the other components of the cooler car 2. Each lamella 12 has a profile with a concave portion 12.1 that is installed to be upwards concave and that is connected by a rising portion 12.2 to a horizontal overlap portion 12.3 at the opposite and of the lamella 12. As can best be seen in FIG. 8, the lamellae 12 are installed so that an air gap 16 is formed between 2 neighbouring lamellae 12. Therefore an efficient air flow through the lamella grate 10 is provided, especially since the collecting pans 6 have been removed. The lamellae 12 are supported by each support element 14, which has an undulating upper contour that matches the profile of the lamellae 12. The overlap portion 12.3 of each lamella 12 overlaps the concave portion 12.1 of a neighbouring lamella 12. During operation, this prevents at least some sinter material from falling into the air gap 16. Other sinter material is received in the concave portion 12.1 and is thereby prevented from falling to any components below the cooler car 2.

Moreover, because the lamellae 12 are to some degree movable with respect to the support structure 13, any clogging of the air gap 16 by sinter material is prevented. For example, when the cooler car 2 reaches a discharge area of the sinter cooler 1, it is tilted to allow sinter material to fall off the lamella grate 10. Thus, by force of gravity, the lamellae 12 normally move individually with respect to the support structure 13, which normally causes any material stuck within the air gap 16 to fall off. Thus, the lamella grate 10 has a self-cleaning functionality.

Figure 10:
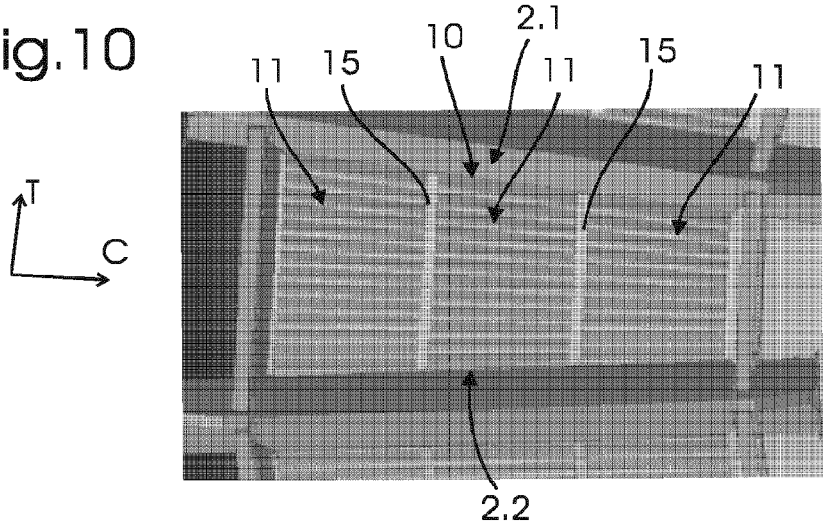
FIG. 10 is a top view of a part of the sinter cooler from FIG. 1 with the cooler car from FIG. 6.

FIG. 10 is a top view of a part of the sinter cooler one with the cooler car to after the retrofitting process. All lamella groups 11 are installed so that the lamellae 12 at the front edge 2.1 of the cooler car 2 and the rear edge 2.2 of the cooler car 2 are parallel to the respective edge 2.1, 2.2. More specifically, all lamellae 12 are aligned towards the centre of the sinter cooler 1 so that the alignment of the lamellae 12 changes gradually between the front edge 2.1 and the rear edge 2.2. In this embodiment of the method, a straight downholder is 15 are installed, which of course necessitates that each lamella 12 has a length that differs from the neighbouring lamella 12.

Figure 11:
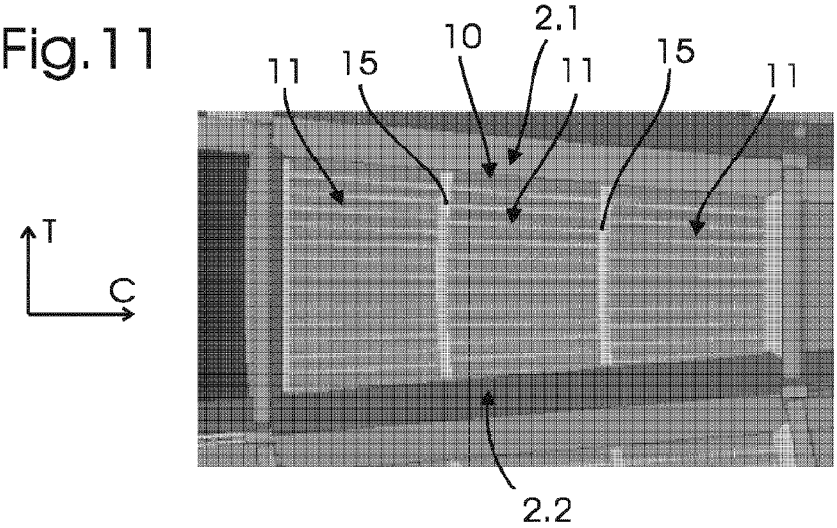
FIG. 11 is a top view corresponding to FIG. 10 with a cooler car after being retrofitted by a second embodiment of the inventive method.

FIG. 11 illustrates the results of a second embodiment of the inventive method, where arcuate downholders 15 are installed. Each downholder 15 corresponds to an arc around the centre of the sinter cooler 1. In this embodiment, at least some neighbouring lamellae 12 may have the same length. Like in the embodiment shown in FIG. 10, all lamellae 12 are aligned towards the centre of the sinter cooler 1.

Figure 12:
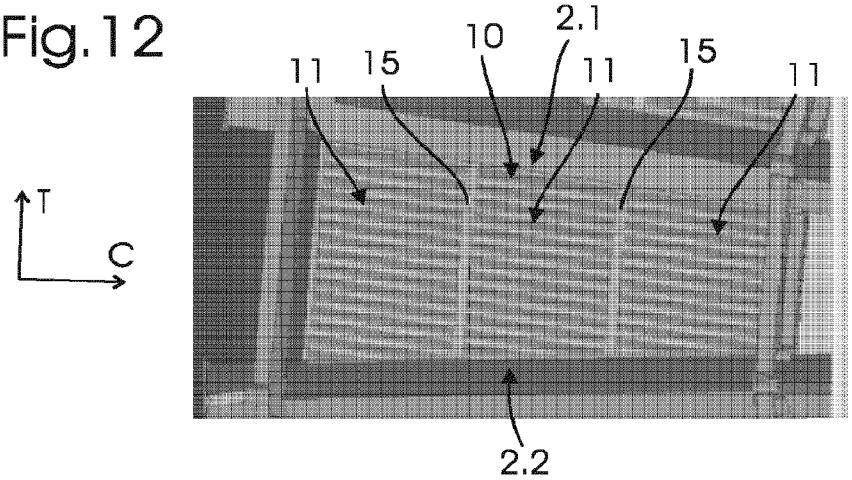
FIG. 12 is a top view corresponding to FIG. 10 with a cooler car after being retrofitted by a third embodiment of the inventive method.

FIG. 12 illustrates the results of a third embodiment of the inventive method, where straight downholders 15 have been installed. In contrast to the embodiment shown in FIG. 10 though, all lamellae 12 are installed to be parallel to each other and to the front edge 2.1 of the cooler car 2. While most of the lamellae 12 in each lamella group 11 can have the same length, this does not hold for the lamellae 12 near the rear edge 2.2. Also, mounting of the lamellae 12 near the rear edge 2.2 is more complicated than in the embodiments shown in FIGS. 10 and 11.

The invention claimed is:

1. A method for fitting a sinter cooler, which sinter cooler comprises a cooler grate chain with an endless chain of cooler cars, each cooler car having a front edge and a rear edge, the method comprising:

providing a plurality of lamellae, each having a lamellae profile at an underside;

providing a plurality of support elements, each having an upper contour that at least partially corresponds to the lamellae profile;

connecting the plurality of support elements to a chassis of a cooler car;

disposing the plurality of lamellae on top of the plurality of support elements opposite from the chassis such that the lamellae profiles of the plurality of lamellae are aligned with the respective upper contours of the plurality of support elements and the plurality of lamellae are arranged generally perpendicular to a direction of travel of the cooler car;

arranging the plurality of lamellae on the plurality of support structures so as to be individually movable with respect to the support structures during operation of the sinter cooler; and disposing a downholder above the plurality of lamella to limit an upward motion of the plurality of lamellae;

wherein the plurality of lamellae form a lamella grate for holding sinter material and allowing air flow through the lamella grate.

2. The method according to claim 1, wherein installing the lamella grate comprises at least partially connecting the support structure to the cooler car and afterwards installing at least some lamellae on the support structure.

3. The method according to claim 1, wherein at least one lamella having a profile with a concave portion and an overlap portion is installed so that the concave portion is upward concave and the overlap portion overlaps the concave portion of a neighbouring lamella from above.

4. The method according to claim 1, wherein a plurality of lamellae are installed as a lamella group so that the lamellae are disposed successively along a travelling direction (T) of the cooler car.

5. The method according to claim 4, wherein all lamellae of at least one lamella group are installed to be parallel to each other and to one edge (2.1, 2.2) of the cooler car (2).

6. The method according to claim 4, wherein at least two lamella groups are installed to be offset to each other perpendicular to the travelling direction (T), wherein a downholder (is installed between two neighbouring lamella groups.

7. The method according to claim 4, wherein at least one lamella group is installed so that the lamellae at the front edge of the cooler car and the rear edge of the cooler car are parallel to the respective edge.

8. The method according to claim 1, wherein at least one straight downholder is installed.

9. The method according to claim 1, wherein at least one arcuate downholder is installed.

10. The method according to claim 1, wherein the sinter cooler is a circular cooler, wherein each cooler car has a front edge slanted with respect to a rear edge.

11. A method according to claim 1, wherein the sinter cooler is a linear cooler.

12. A method for retrofitting a sinter cooler, which sinter cooler comprises a cooler grate chain with an endless chain of cooler cars, each cooler car having a front edge, a rear edge, and a rigid grate for holding sinter material and allowing air flow through the rigid grate, the method comprising:

removing the rigid grate;

providing a plurality of lamellae, each having a lamellae profile at an underside;

providing a plurality of support elements, each having an upper contour that at least partially corresponds to the lamellae profile;

connecting the plurality of support elements to a chassis of a cooler car;

disposing the plurality of lamellae on top of the plurality of support elements opposite from the chassis such that the lamellae profiles of the plurality of lamellae are aligned with the respective upper contours of the plurality of support elements and the plurality of lamellae are arranged generally perpendicular to a direction of travel of the cooler car;

arranging the plurality of lamellae on the plurality of support structures so as to be individually movable with respect to the support structures during operation of the sinter cooler; and disposing a downholder above the plurality of lamella to limit an upward motion of the plurality of lamellae; and wherein the plurality of lamellae form a lamella grate for said holding sinter material and said allowing air flow through the lamella grate.

13. The method according to claim 12, wherein the cooler car comprises at least one collecting pan disposed beneath the rigid grate to collect material falling through the rigid grate, wherein the method comprises removing the at least one collecting pan.

14. The method according to claim 12, wherein installing the lamella grate comprises at least partially connecting the support structure to the cooler car and afterwards installing at least some lamellae on the support structure.

15. The method according to claim 12, wherein at least one lamella having a profile with a concave portion and an overlap portion is installed so that the concave portion is upward concave and the overlap portion overlaps the concave portion of a neighbouring lamella from above.

16. The method according to claim 12, wherein a plurality of lamellae are installed as a lamella group so that the lamellae are disposed successively along a travelling direction of the cooler car.

17. The method according to claim 16, wherein all lamellae of at least one lamella group are installed to be parallel to each other and to one edge of the cooler car.

18. The method according to claim 16, wherein at least two lamella groups are installed to be offset to each other perpendicular to the travelling direction, wherein a downholder is installed between two neighbouring lamella groups.

19. The method according to claim 16, wherein at least one lamella group is installed so that the lamellae at the front edge of the cooler car and the rear edge of the cooler car are parallel to the respective edge.

20. The method according to claim 12, wherein at least one straight downholder is installed.

21. The method according to claim 12, wherein at least one arcuate downholder is installed.

22. The method according to claim 12, wherein the sinter cooler is a circular cooler, wherein each cooler car has a front edge slanted with respect to a rear edge.

23. The method according to claim 12, wherein the sinter cooler is a linear cooler.

* * * * *